US008109041B2

(12) United States Patent
Kita

(10) Patent No.: US 8,109,041 B2
(45) Date of Patent: Feb. 7, 2012

(54) POWERED DEVICE FOR VEHICLE SLIDING MEMBER

(75) Inventor: Shinichiro Kita, Yokohama (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 1090 days.

(21) Appl. No.: 11/785,882

(22) Filed: Apr. 20, 2007

(65) Prior Publication Data

US 2008/0047201 A1 Feb. 28, 2008

(30) Foreign Application Priority Data

Aug. 22, 2006 (JP) ..... 2006-225042

(51) Int. Cl.
*E05F 11/54* (2006.01)

(52) U.S. Cl. ..... 49/360; 192/84.961

(58) Field of Classification Search ..... 49/360; 296/146.1, 155; 192/84.961
See application file for complete search history.

(56) References Cited

U.S. PATENT DOCUMENTS

| | | | | |
|---|---|---|---|---|
| 754,291 | A | 3/1904 | Eastwood | |
| 3,091,316 | A | 5/1963 | Huffman | |
| 4,346,616 | A | 8/1982 | Geisslinger et al. | |
| 5,639,074 | A | 6/1997 | Greenhill et al. | |
| 6,237,737 | B1 | 5/2001 | Jorgensen et al. | |
| 6,409,000 | B1 | 6/2002 | Itoh et al. | |
| 7,275,629 | B2 * | 10/2007 | Fukumoto et al. | 192/84.961 |
| 2005/0055883 | A1 * | 3/2005 | Sato et al. | 49/360 |
| 2005/0183924 | A1 | 8/2005 | Fukumoto et al. | |
| 2006/0156630 | A1 * | 7/2006 | Yokomori et al. | 49/360 |
| 2008/0053781 | A1 | 3/2008 | Kita | |

FOREIGN PATENT DOCUMENTS

| | | |
|---|---|---|
| EP | 1 566 511 A2 | 8/2005 |
| GB | 2 124 696 A | 2/1984 |
| JP | 62-59270 (U) | 4/1987 |
| JP | 2005-232918 A | 9/2005 |

OTHER PUBLICATIONS

Kita Shinichiro, U.S. PTO Office Action, U.S. Appl. No. 11/892,234, dated Apr. 14, 2010, 11 pgs.
Shinichiro Kita, U.S. PTO Office Action, U.S. Appl. No. 11/892,234, dated Oct. 14, 2009, 11 pgs.

* cited by examiner

*Primary Examiner* — Gregory J. Strimbu
(74) *Attorney, Agent, or Firm* — Foley & Lardner LLP

(57) ABSTRACT

A powered device for a vehicle sliding member includes a base member, a shaft rotatably supported on the base member, a drive source, a speed reduction mechanism, an output drum rotatably supported on the base member through the shaft, a clutch mechanism which includes a rotor rotatably and coaxially disposed on the shaft, a generally cylindrical field core disposed on the rotor, and an armature which is disposed on the shaft so as to be rotatable about and moveable in an axial direction of the shaft, a first stop which limits axial displacement of the rotor relative to the shaft, and a second stop which limits axial displacement of the field core relative to the rotor.

16 Claims, 4 Drawing Sheets

POWERED DEVICE FOR VEHICLE SLIDING MEMBER

BACKGROUND OF THE INVENTION

The present invention relates to a powered sliding device for a vehicle sliding member which is slidably moved between an open position and a closed position in a vehicle.

Conventionally, there has been proposed a powered sliding device for a vehicle sliding member which includes a base member and an output drum which is rotatably supported on the base member through a shaft. The output drum has a cable which is wound around an outer circumferential surface of the output drum and connected with the vehicle sliding member. The powered sliding device further includes a speed reduction mechanism connected to a motor, and a clutch mechanism for selectively switchable between an engaged state in which the clutch mechanism transmits a driving torque inputted from the motor via the speed reduction mechanism, to the output drum and a disengaged state in which the clutch mechanism prevents the driving torque from being transmitted to the output drum.

The clutch mechanism includes an annular field core fixed to the base member, a rotor rotatably supported on the shaft, and an armature which is supported on the shaft so as to be rotatable about an axis of the shaft and moveable in the axial direction of the shaft. The armature is constructed to be rotatable together with the output drum. When an electromagnetic winding in the field core is energized, the armature is magnetically attracted to the rotor and frictionally engaged with the rotor. The rotation of the rotor is transmitted to the output drum through the frictional engagement between the armature and the rotor, causing the vehicle sliding member to move the open position and the closed position via the cable.

Japanese Patent Application First Publication No. 2005-232918, corresponding to U.S. Patent Application Publication No. 2005/0183924 A1, describes such a powered sliding device as discussed above.

SUMMARY OF THE INVENTION

However, in the conventional powered sliding device as described above, the field core, the rotor, the armature and the output drum must be in turn axially assembled to the base member to which the motor and the speed reduction mechanism are previously mounted. This assembling work causes inconvenience and tends to be deteriorated in accuracy.

It is an object of the present invention to eliminate the above problems in the conventional art and provide a powered sliding device capable of provisionally assembling the clutch mechanism and the output drum together with each other before coupling the speed reduction mechanism to the clutch mechanism, and capable of facilitating the assembling work of the powered sliding device.

To achieve the above object, there is provided according to one aspect of the present invention, a powered device for a vehicle sliding member, comprising: a base member; a shaft rotatably supported on the base member; a drive source; an output drum rotatably supported on the base member through the shaft; a clutch mechanism switchable between an engaged state in which the clutch mechanism transmits a driving torque from the drive source to the output drum, and a disengaged state in which the clutch mechanism prevents the driving torque from being transmitted to the output drum; and a first stop. The clutch mechanism comprises: a rotor rotatably disposed relative to the shaft, a generally cylindrical field core disposed on the rotor, and an armature disposed on the shaft so as to be rotatable and moveable along an axis of the shaft. The armature is connected with the output drum, and has a friction surface which is opposed to the friction surface of the rotor and engageable therewith. The armature is magnetically attracted to the rotor and transmits rotation of the rotor to the output drum through the friction surfaces of the armature and rotor being engaged with each other upon energizing the field core.

DETAILED DESCRIPTION OF THE INVENTION

Figure 1:
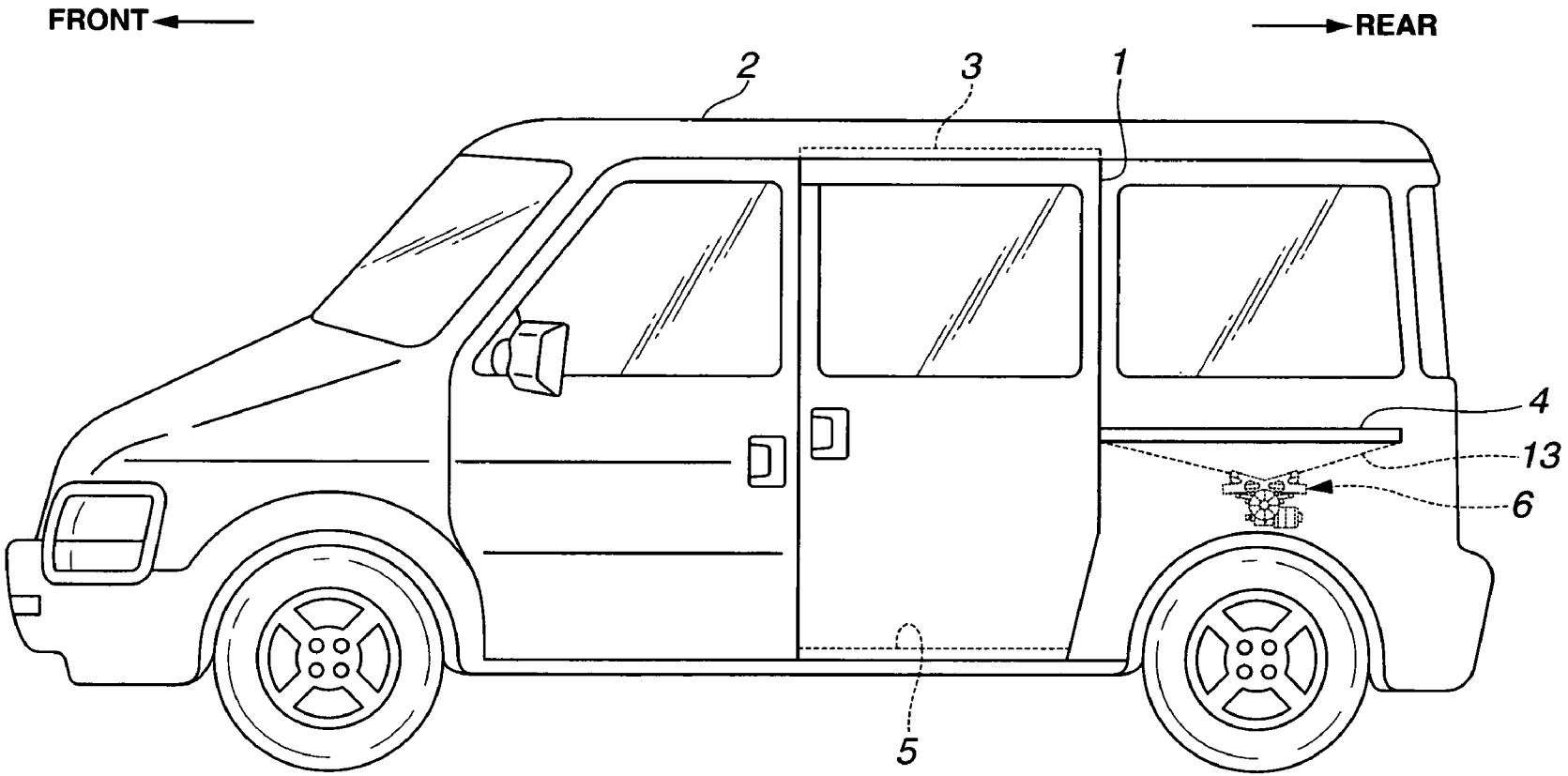
FIG. 1 is a side view of a vehicle to which a powered sliding device of an embodiment of the present invention is incorporated.

In the following, an embodiment of the present invention will be explained in detail with reference to the accompanying drawings. For ease of understanding, various directional terms, such as, right, left, upper, lower, rightward and the like as viewed in the drawings are used in the following description. However, such terms are to be understood with respect to only the drawings on which the corresponding part or portion is shown.

FIG. 1 shows a side view of a vehicle of a mini-van or wagon type to which a powered sliding device of the embodiment which is incorporated. The powered sliding device is provided on left and right sides of vehicle body 2. In FIG. 1, there is shown only the powered sliding device as indicated at 6, which is provided on the left side of the vehicle body. As illustrated in FIG. 1, slide door 1 as a sliding member of the vehicle is supported by upper guide rail 3, middle guide rail 4 and lower guide rail 5 so as to be moveable between a full-closed position in which slide door 1 allows an opening of vehicle body 2 for ingress/egress of a vehicle occupant to be fully covered, and a full-open position in which slide door 1 allows the opening of vehicle body 2 to be fully exposed to an outside of the vehicle, in a fore-and-aft direction of the vehicle. Slide door 1 is moveable rearward and forward from the full-closed position to the full-open position and vice versa along the side of vehicle body 2, while slightly outward moving from an outside surface of vehicle body 2. Slide door 1 can be thus moved by manual operation and powered sliding device 6 which is installed to a rear side portion of vehicle body 2.

Figure 2:
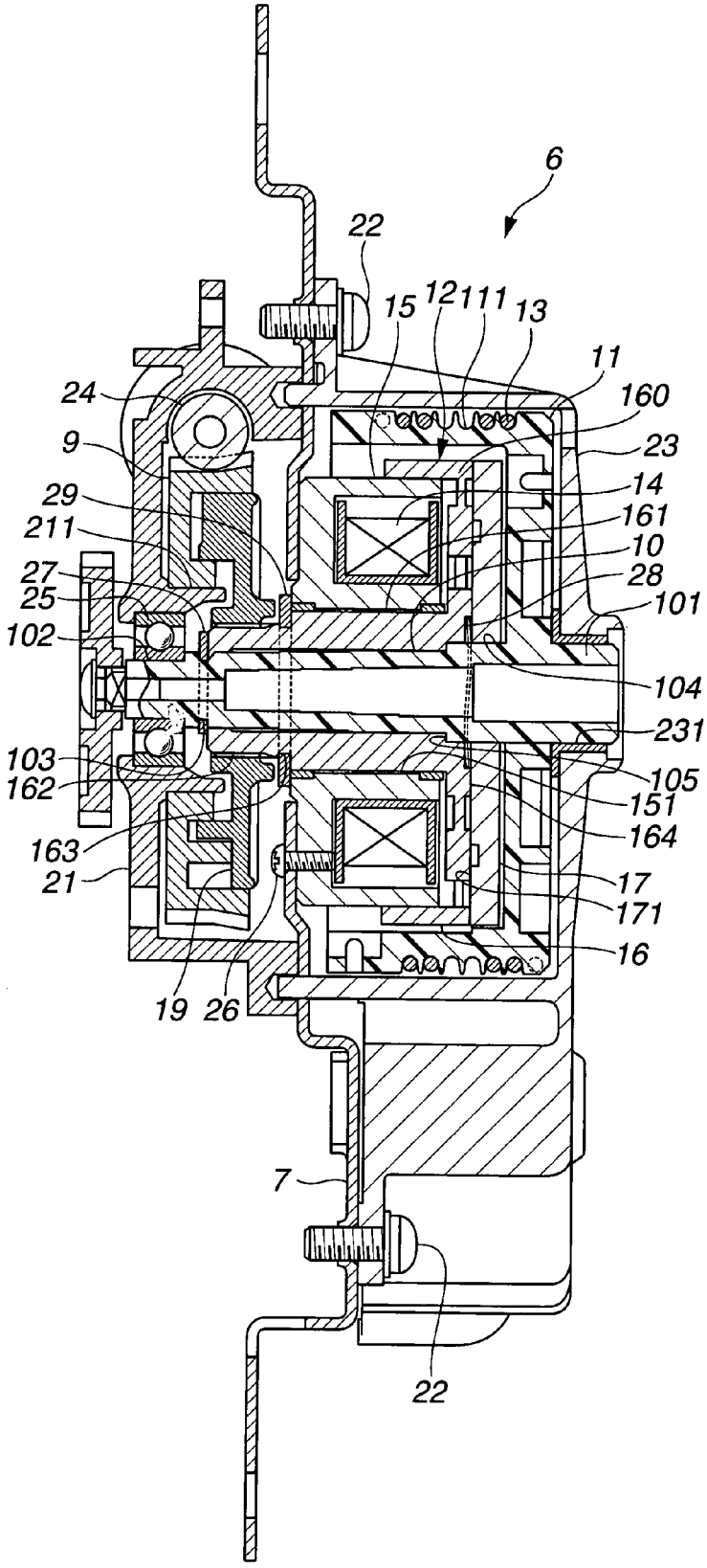
FIG. 2 is a vertical cross-section of the powered sliding device.
Figure 3:
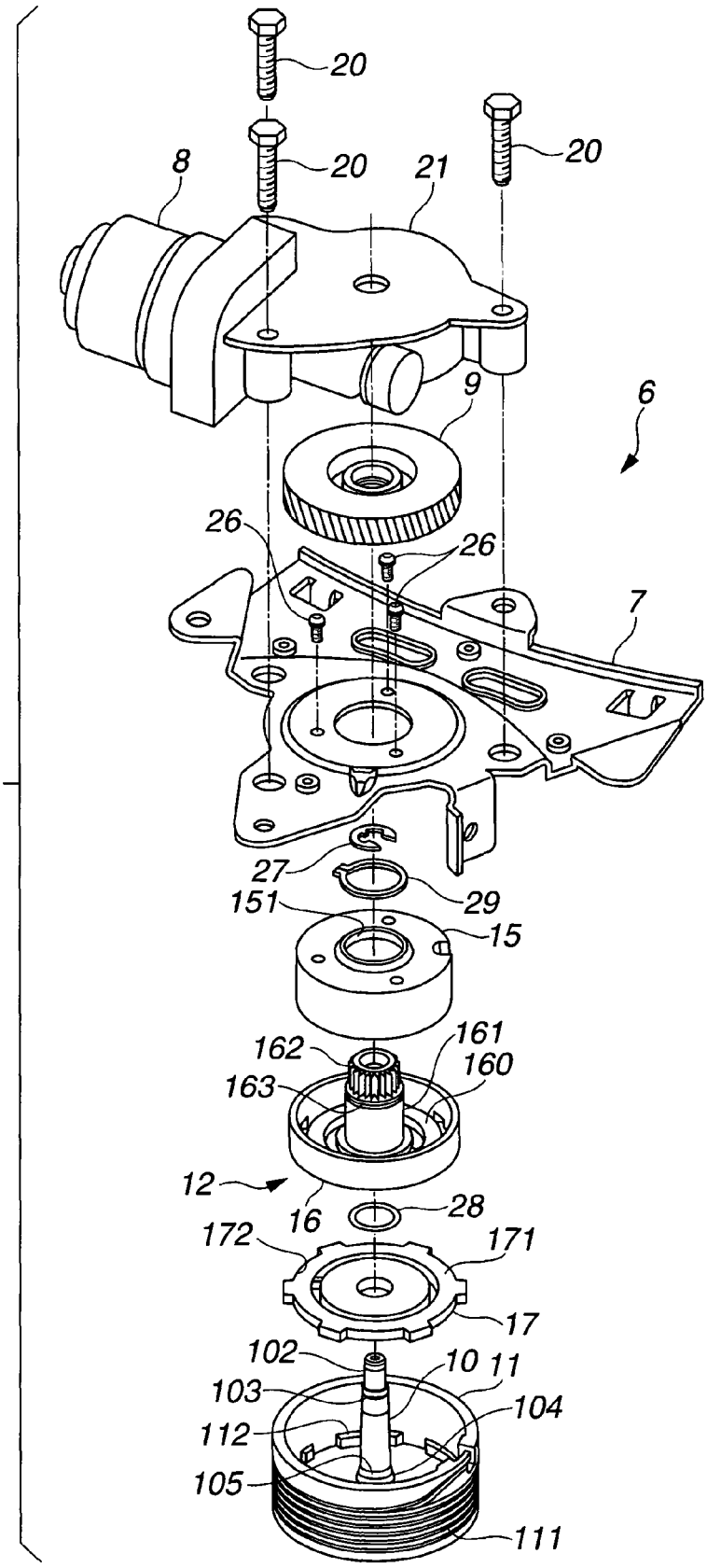
FIG. 3 is an exploded perspective view of the powered sliding device.
Figure 4:
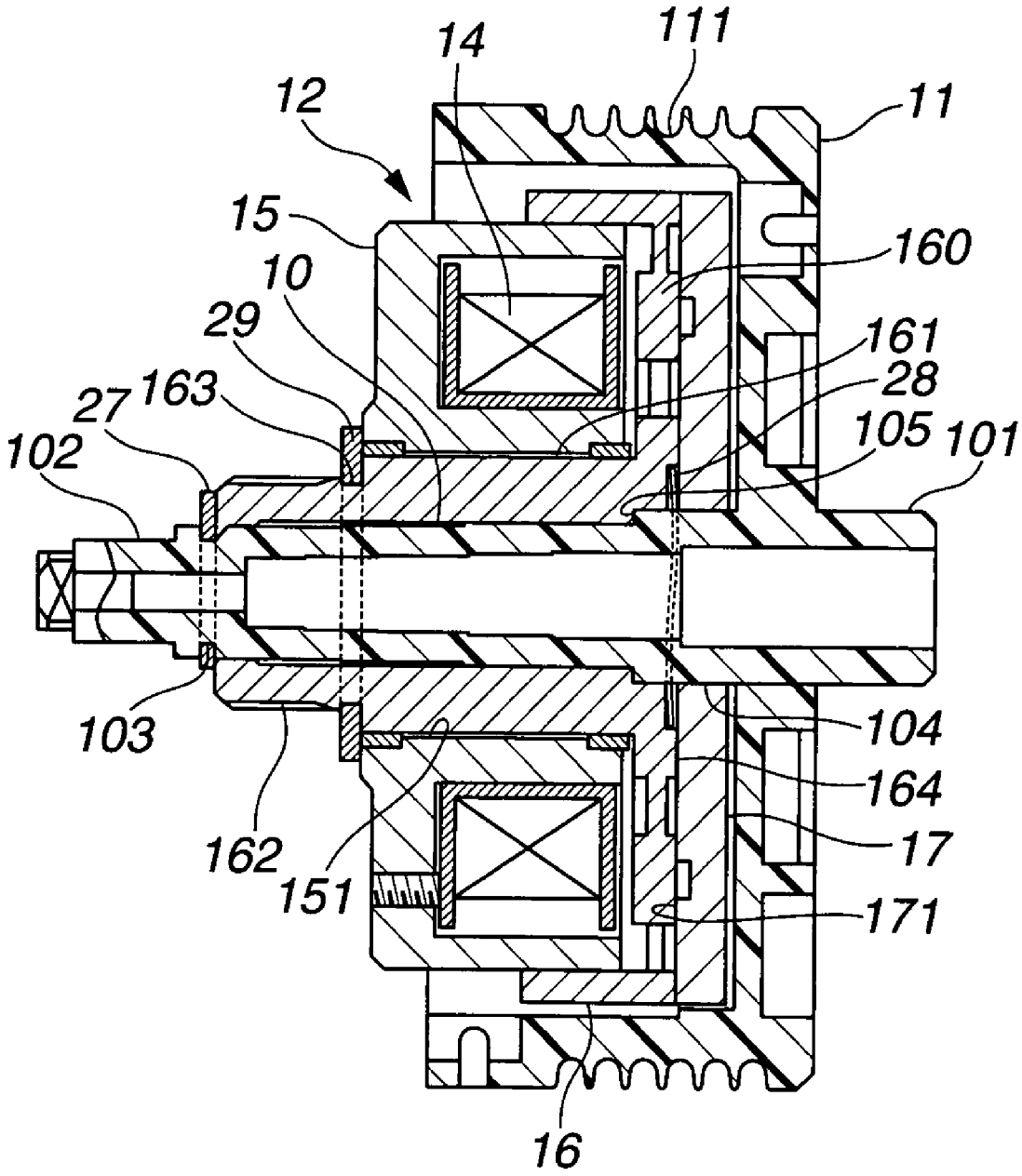
FIG. 4 is a vertical cross-section of an essential part of the powered sliding device and shows a clutch mechanism assembled to a shaft and an output drum.

Referring to FIGS. 2-4, powered sliding device 6 is explained in detail. As illustrated in FIGS. 2 and 3, powered sliding device 6 includes base member 7, motor 8 serving as a drive source, worm wheel 9 serving as a speed reduction mechanism for reducing a rotation speed of motor 8, output drum 11 which is rotatably supported on base member 7 through shaft 10 and connected with slide door 1 through cable 13, and clutch mechanism 12 for allowing driving connection between worm wheel 9 and output drum 11 and blocking the driving connection therebetween.

Base member 7 is fixed to vehicle body 2 and in the form of a metal plate. Base member 7 has one side surface, namely, a left side surface as viewed in FIG. 2, on which gear housing 21 is fixedly disposed. As shown in FIG. 3, gear housing 21 is fixed to an upper surface of base member 7 by means of screws 20. Base member 7 has an opposite side surface, namely, a right side surface as viewed in FIG. 2, to which housing 23 is fixed by means of screw 22. Housing 23 accommodates output drum 11 and clutch mechanism 12 as explained later. Motor 8 is mounted to the one side surface of base member 7 through gear housing 21. In this embodiment, motor 8 is in the form of a reversible motor.

Worm wheel 9 is rotatably accommodated within gear housing 21. Worm wheel 9 is fitted onto sleeve 211 formed inside gear housing 21, and is rotatably supported on sleeve 211. Worm wheel 9 meshes with worm 24 which is fixed to an output shaft of motor 8, and is rotatable to reduce the rotation of motor 8. Worm wheel 9 has damper plate 19 on a radial inside thereof. Damper plate 19 is constructed to be rotatable together with worm wheel 9. Damper plate 19 acts to damp an impact which is caused when the rotation of worm wheel 9 is transmitted to rotor 16 of clutch mechanism 12.

Output drum 11 is formed into a generally cylindrical shape having one closed end. Output drum 11 has an inside bottom surface, namely, a left side surface as viewed in FIG. 2. Output drum 11 carries cable 13 which is wound on an outer circumferential surface of output drum 11. Cable 13 is engaged in helical groove 111 which is formed on the outer circumferential surface of output drum 11. Helical groove 111 is best shown in FIG. 3. As shown in FIG. 3, output drum 11 has a plurality of projections 112 on an inner circumferential surface thereof. Projections 112 radially inward extend from the inner circumferential surface of output drum 11 and are circumferentially spaced from each other. Projections 112 are engaged in recesses 172 of armature 17 of clutch mechanism 12 as explained later.

As shown in FIG. 1, cable 13 wound on output drum 11 extends along guide rail 4 and is connected to slide door 1. Cable 13 serves as a transmitting member which transmits the driving torque of motor 8 inputted to output drum 11 to slide door 1. Cable 13 is supported and guided by guide portions, not shown, which are provided on front and rear end portions of guide rail 4, respectively.

Shaft 10 extends through an opening of base member 7 in a lateral direction of the vehicle perpendicular to the fore-and-aft direction of the vehicle. Shaft 10 is supported on gear housing 21 and housing 23 so as to be rotatable about an axis thereof. Shaft 10 is integrally formed with output drum 11. Shaft 10 includes one end portion 101 which is rotatably fitted into bearing hole 231 of housing 23. Opposite end portion 102 of shaft 10 is rotatably supported on bearing sleeve 211 of gear housing 21 through bearing 25. Shaft 10 further includes a clutch mounting portion which is disposed between one end portion 101 and opposite end portion 102 and supports clutch mechanism 12 thereon. The clutch mounting portion includes a major portion, increased diameter portion 104 which is larger in diameter than the major portion, and step 105 disposed between the major portion and increased diameter portion 104. Increased diameter portion 104 axially extends from a radially inner periphery of the inside bottom surface of output drum 11. Circumferential groove 103 is formed on an outer circumferential surface of shaft 10 between opposite end portion 102 and the clutch mounting portion. Circumferential groove 103 is engaged with stop 27 as explained later.

Clutch mechanism 12 is switchable between an engaged state in which clutch mechanism 12 transmits a driving torque which is inputted from motor 8 via worm wheel 9, to output drum 11 and a disengaged state in which clutch mechanism 12 prevents the driving torque from being transmitted to output drum 11. Clutch mechanism 12 includes field core 15, rotor 16 and armature 17 which are disposed on the clutch mounting portion of shaft 10. Field core 15, rotor 16 and armature 17 are accommodated within an inside space of output drum 11. Field core 15 includes built-in electromagnetic winding 14 and is made of a magnetic material. Field core 15 is formed into a generally cylindrical shape with central hole 151 and disposed on rotor 16 coaxially therewith. Field core 15 has one axial end surface contacted with the other side surface of base member 7 which faces toward housing 23. Field core 15 is fixed to the other side surface of base member 7 by means of screws 26. An opposite axial end surface of field core 15 is opposed to generally annular portion 160 of rotor 16 as explained later.

Rotor 16 is made of a magnetic material and rotatably and coaxially disposed on the major portion of the clutch mounting portion of shaft 10. Rotor 16 has friction surface 164 at one axial end thereof. Specifically, rotor 16 includes generally annular portion 160 which has friction surface 164 on one side thereof, and cylindrical hub 161 which extends from an opposite side of annular portion 160 in the axial direction. Annular portion 160 has a central hole, a flange axially extending from an outer circumferential periphery, and a circumferential recess which is formed on an inner circumferential surface around the central hole. The inner circumferential recess is configured to be fitted onto increased diameter portion 104 of the clutch mounting portion of shaft 10. Hub 161 extends from a radially inner periphery of the opposite side surface of annular portion 160 into gear housing 21 through central hole 151 of field core 15. Hub 161 includes a large-diameter portion which is located in central hole 151 of field core 15 and a small-diameter portion which projects from central hole 151 and the opening of base member 7 and is located within gear housing 21. The small-diameter portion has knurl 162 at which hub 161 is connected with worm wheel 9 through damper plate 19. Hub 161 has circumferential groove 163 on an outer circumferential surface thereof between the large-diameter portion and the small-diameter portion. Circumferential groove 163 is engaged with stop 29 as explained later.

Armature 17 is disposed on increased diameter portion 104 of the clutch mounting portion of shaft 10 coaxially with shaft 10. Armature 17 is rotatable about the axis of shaft 10 and moveable in the axial direction of shaft 10. Armature 17 is formed into a disc shape with a central hole and has friction surface 171 on one side thereof which is opposed to friction surface 164 of annular portion 160 of rotor 16. The other side of armature 17 is opposed to the inside bottom surface of output drum 11. Displacement of armature 17 in an axial direction of shaft 10, namely, in the rightward direction as viewed in FIG. 2, is limited by the inside bottom surface of output drum 11. As shown in FIG. 3, armature 17 has a plurality of recesses 172 on an outer circumferential surface thereof. Recesses 172 are radially inward concaved from the outer circumferential surface of armature 17 and circumferentially spaced from each other. Recesses 172 are engaged with projections 112 of output drum 11 to thereby connect armature 17 to output drum 11. Upon energizing field core 15, armature 17 is magnetically attracted to annular portion 160 of rotor 16 and transmits rotation of rotor 16 to output drum 11 through friction surfaces 171 and 164 which are frictionally engaged with each other.

Stop 27 is disposed on shaft 10 between opposite end portion 102 and the clutch mounting portion. Stop 27 is a ring-shaped member and fitted into circumferential groove 103 which is formed on the outer circumferential surface of shaft 10. Stop 27 is contacted with an axial end surface of hub 161 of rotor 16 and limits displacement of rotor 16 of clutch mechanism 12 relative to shaft 10 in an axial direction of shaft 10 toward opposite end portion 102, namely, in the leftward direction as viewed in FIG. 2. Stop 27 cooperates with step 105 of the clutch mounting portion of shaft 10 to prevent backlash of rotor 16 relative to shaft 10 in opposite axial directions of shaft 10 and securely support hub 161 between stop 27 and step 105. Stop 27 also prevents rotor 16 from dropping off from opposite end portion 102 of shaft 10 before worm wheel 9 is coupled to rotor 16 upon assembling powered sliding device 6 as explained later. In this embodiment, stop 27 is in the form of an E-washer. By using stop 27, the assembling operation of powered sliding device 6 can be efficiently performed.

Stop 29 is disposed on hub 161 of rotor 16 and located between armature 17 and stop 27 in the axial direction of rotor 16. Stop 29 is a ring-shaped member and fitted into circumferential groove 163 which is formed on the outer circumferential surface of hub 161 between the large-diameter portion and the small-diameter portion. Stop 29 is contacted with a radially inner periphery of the one axial end surface of field core 15 and limits displacement of field core 15 relative to rotor 16 in an axial direction of rotor 16 toward damper plate 19, namely, in the leftward direction when viewed in FIG. 2. Stop 29 cooperates with annular portion 160 of rotor 16 to prevent backlash of field core 15 relative to hub 161 in opposite axial direction of rotor 16 and securely support field core 15 between stop 29 and annular portion 160. Stop 29 also prevents field core 15 from dropping off from hub 161 of rotor 16 before worm wheel 9 is coupled to rotor 16 upon assembling powered sliding device 6. By using stop 29, the assembling operation of powered sliding device 6 can be facilitated and efficiently performed.

Biasing member 28 is disposed between annular portion 160 of rotor 16 and armature 17. Biasing member 28 is fitted onto increased diameter portion 104 of the clutch mounting portion of shaft 10 and interposed between a radially inner periphery of friction surface 164 of rotor 16 and a radially inner periphery of friction surface 171 of armature 17 which is opposed to the radially inner periphery of friction surface 164 in the axial direction of shaft 10. Biasing member 28 is constructed to be elastically deformable to bias rotor 16 and armature 17 in such a direction as to move friction surfaces 164 and 171 away from each other. That is, biasing member 28 biases rotor 16 and armature 17 in opposite axial directions of shaft 10. In this embodiment, biasing member 28 is in the form of a wave washer.

When electromagnetic winding 14 of field core 15 is energized and clutch mechanism 12 is placed in the engaged state, armature 17 is magnetically attracted to rotor 16 so that friction surfaces 171 and 164 are frictionally engaged with each other to thereby establish driving connection between rotor 16 and armature 17. In this state, the rotation of motor 8 is transmitted to output drum 11 via worm 24, worm wheel 9, damper plate 19, rotor 16 and armature 17. Then, cable 13 is taken up over the outer circumferential surface of output drum 11 to thereby move slide door 1 in the open or closed direction. On the other hand, when electromagnetic winding 14 of field core 15 is de-energized and clutch mechanism 12 is placed in the disengaged state, armature 17 is prevented from being magnetically attracted to rotor 16 so that friction surfaces 171 and 164 are free from frictional engagement with each other to thereby inhibit driving connection between rotor 16 and armature 17. In this state, the rotation of motor 8 is not transmitted to output drum 11 and slide door 1 can be manually operated in the open or closed direction without inversely rotating motor 8 and worm wheel 9.

Powered sliding device 6 of this embodiment can perform the following effects. With the provision of stop 27, displacement of rotor 16 of clutch mechanism 12 relative to shaft 10 in the axial direction of shaft 10 toward opposite end portion 102 can be limited. Further, with the cooperation of stop 27 and step 105 of the clutch mounting portion of shaft 10, backlash of rotor 16 relative to shaft 10 in the opposite axial directions of shaft 10 can be effectively suppressed so that hub 161 is securely supported between stop 27 and step 105.

With the provision of stop 29, displacement of field core 15 relative to rotor 16 in the axial direction of rotor 16 toward damper plate 19 can be limited. Further, with the cooperation of stop 29 and annular portion 160 of rotor 16, backlash of field core 15 relative to rotor 16 in the opposite axial directions of rotor 16 can be effectively suppressed so that field core 15 is securely supported between stop 29 and annular portion 160.

With the arrangement of biasing member 28 between annular portion 160 of rotor 16 and armature 17, rotor 16 and armature 17 can be free from axial backlash on shaft 10, respectively.

With the construction of shaft 10 integrally formed with output drum 11, the number of parts of powered sliding device 6 can be reduced to thereby simplify the construction of powered sliding device 6.

With the connection of hub 161 of rotor 16 with worm wheel 9, rotor 16 can be surely coupled to worm wheel 9 as the speed reduction mechanism and the construction of powered sliding device 6 can be simplified.

A method of assembling powered sliding device 6 of this embodiment will be explained hereinafter. First, armature 17 and rotor 16 of clutch mechanism 12 are mounted onto the clutch mounting portion of shaft 10 integrally formed with output drum 11, in such a manner that friction surface 171 of armature 17 and friction surface 164 of rotor 16 are opposed to each other. Upon this mounting operation, armature 17 is placed in a circumferential position on increased diameter portion 104 of the clutch mounting portion such that recesses 172 of armature 17 are engaged with projections 112 of output drum 11. Subsequently, stop 27 is fitted into circumferential groove 103 of shaft 10 to thereby prevent rotor 16 from dropping off from shaft 10. Thus, rotor 16 and armature 17 are provisionally assembled to shaft 10 without dropping off from shaft 10.

Next, field core 15 with electromagnetic winding 14 is mounted onto hub 161 of rotor 16. Stop 29 is then fitted into circumferential groove 163 of hub 161 to thereby prevent field core 15 from dropping off from hub 161. Thus, field core 15 is provisionally assembled to rotor 16 without dropping off from rotor 16. Clutch mechanism 12 is thus assembled to shaft 10 and output drum 11. FIG. 4 shows the assembled state of clutch mechanism 12.

Subsequently, field core 15 of clutch mechanism 12 is fixed to base member 7 by means of screws 26. Clutch mechanism 12 assembled to shaft 10 and output drum 11 is thus assembled to base member 7. Next, worm wheel 9 is coupled to hub 161 of rotor 16 by engaging damper plate 19 with knurl 162 of the small-diameter portion of hub 161. Motor 8 which is previously accommodated in gear housing 21, is coupled to worm wheel 9 through worm 24. Thus, motor 8 and gear housing 21 are mounted to base member 7 through worm wheel 9 and clutch mechanism 12.

The method of assembling powered sliding device 6 of this embodiment can perform the following effects. By using stop 27 and stop 29 fitted into corresponding circumferential grooves 103 and 163, rotor 16 and armature 17 can be provisionally assembled to shaft 10 without dropping off from shaft 10 and field core 15 can be provisionally assembled to rotor 16 without dropping off from rotor 16, before coupling worm wheel 9 to rotor 16. Therefore, clutch mechanism 12 can be efficiently assembled to shaft 10 integrally formed with output drum 11. This serves for facilitating the assembling operation of powered sliding device 6.

In powered sliding device 6 of this embodiment, shaft 10 is integrally formed with output drum 11. However, shaft 10 and output drum 11 can be formed as separate members independent of each other. Further, damper plate 19 can be omitted and rotor 16 can be directly connected with worm wheel 9. Further, biasing member 28 can be disposed between output drum 11 and armature 17 so as to bias armature 17 in such a direction as to always contact friction surface 171 of armature 17 with friction surface 164 of rotor 16. With this arrangement of biasing member 28, rotor 16 and armature 17 can be free from axial backlash relative to each other on shaft 10. Furthermore, although powered sliding device 6 is applied to slide door 1 in the above-described embodiment, powered sliding device 6 may be applied to various kinds of vehicle sliding members such as a back door, a sunroof, a window and the like.

This application is based on a prior Japanese Patent Application No. 2006-225042 filed on Aug. 22, 2006. The entire contents of the Japanese Patent Application No. 2006-225042 is hereby incorporated by reference.

Although the invention has been described above by reference to a certain embodiment of the invention, the invention is not limited to the embodiment described above. Modifications and variations of the embodiment described above will occur to those skilled in the art in light of the above teachings. The scope of the invention is defined with reference to the following claims.

What is claimed is:

1. A powered device for a vehicle sliding member, comprising:

a base member adapted to be fixed to a vehicle body;

a shaft rotatably supported on the base member;

a drive source;

a speed reduction mechanism configured to reduce an output speed of the drive source;

an output drum rotatably supported on the base member through the shaft, the output drum being adapted to be connected to the vehicle sliding member;

a clutch mechanism switchable between an engaged state in which the clutch mechanism transmits a driving torque, which is inputted from the drive source via the speed reduction mechanism, to the output drum, and a disengaged state in which the clutch mechanism prevents the driving torque from being transmitted to the output drum, the clutch mechanism being accommodated inside the output drum, wherein the clutch mechanism comprises:

a rotor rotatably disposed relative to the shaft, the rotor being coaxially disposed on the shaft, the rotor being connected with the speed reduction mechanism and having a friction surface on one axial end thereof, a generally cylindrical field core disposed on the rotor, and an armature disposed on the shaft so as to be rotatable about and moveable along an axis of the shaft, the armature being connected with the output drum, the armature having a friction surface which is opposed to the friction surface of the rotor and engageable therewith, the armature being magnetically attracted to the rotor and transmitting rotation of the rotor to the output drum through the friction surfaces of the armature and rotor being engaged with each other upon energizing the field core;

a first stop that limits displacement of the field core relative to the rotor in an axial direction of the rotor so that the field core is prevented from moving away from the output drum in the axial direction of the rotor, and wherein the first stop is disposed on the rotor and contacted with a radially inner periphery of an axial end surface of the field core.

2. The powered device as claimed in claim 1, further comprising a transmitting member which is wound on the output drum, wherein the transmitting member is configured to connect to the vehicle sliding member.

3. The powered device as claimed in claim 1, further comprising a second stop that limits displacement of the rotor relative to the shaft in an axial direction of the shaft so that the rotor is prevented from moving away from the output drum in the axial direction of the shaft.

4. The powered device as claimed in claim 3, wherein the second stop comprises a ring-shaped member, and wherein the shaft has a circumferential groove on an outer circumferential surface thereof into which the ring-shaped member is fitted.

5. The powered device as claimed in claim 3, wherein the first stop is disposed between the armature and the first second stop in the axial direction of the shaft.

6. The powered device as claimed in claim 3, wherein the second stop is disposed on the shaft and contacted with an axial end surface of the rotor.

7. The powered device as claimed in claim 3, wherein the shaft comprises a major portion, an increased diameter portion larger in diameter than the major portion, and a step disposed between the major portion and the increased diameter portion, wherein the armature is rotatably disposed on the increased diameter portion, and wherein the step cooperates with the second stop to suppress axial backlash of the rotor relative to the shaft.

8. The powered device as claimed in claim 1, wherein the clutch mechanism further comprises a biasing member disposed between the rotor and the armature, and wherein the biasing member biases the friction surface of the rotor and the friction surface of the armature away from each other along the axis of the shaft.

9. The powered device as claimed in claim 1, wherein the shaft is integrally formed with the output drum.

10. The powered device as claimed in claim 1, wherein the rotor comprises a cylindrical hub which extends through the field core.

11. The powered device as claimed in claim 10, wherein the rotor further comprises a generally annular portion having the friction surface of the rotor on one side thereof, and wherein the hub of the rotor axially extends from a side of the annular portion.

12. The powered device as claimed in claim 10, wherein the hub of the rotor comprises a large-diameter portion which is located inside the field core and a small-diameter portion which is connected with the speed reduction mechanism, and wherein the first stop is disposed on the hub between the large-diameter portion and the small-diameter portion.

13. The powered device as claimed in claim 12, wherein the speed reduction mechanism comprises a worm wheel, and wherein the small-diameter portion of the hub of the rotor is connected with the worm wheel.

14. The powered device as claimed in claim 1, wherein the first stop comprises a ring-shaped member, and wherein the rotor has a circumferential groove on an outer circumferential surface thereof into which the ring-shaped member is fitted opposite said one side of the annular portion.

15. A powered device for a vehicle sliding member, comprising:

a base member;

a shaft rotatably supported on the base member;

a drive source;

an output drum rotatably supported on the base member through the shaft, the output drum being adapted to be connected to the vehicle sliding member;

a clutch mechanism switchable between an engaged state in which the clutch mechanism transmits a driving torque from the drive source to the output drum, and a disengaged state in which the clutch mechanism prevents the driving torque from being transmitted to the output drum, the clutch mechanism being accommodated inside the output drum, wherein the clutch mechanism comprises:

a rotor rotatably disposed relative to the shaft, the rotor being coaxially disposed on the shaft, the rotor having a friction surface on one axial end thereof, a generally cylindrical field core disposed on the rotor, and an armature disposed on the shaft so as to be rotatable about and moveable along an axis of the shaft, the armature being connected with the output drum, the armature having a friction surface which is opposed to the friction surface of the rotor and engageable therewith, the armature being magnetically attracted to the rotor and transmitting rotation of the rotor to the output drum through the friction surfaces of the armature and rotor being engaged with each other upon energizing the field core; and a first stop that limits displacement of the field core relative to the rotor in an axial direction of the rotor so that the field core is prevented from moving away from the output drum in the axial direction of the rotor, wherein the first stop is disposed on the rotor and contacted with a radially inner periphery of an axial end surface of the field core.

16. The powered device as claimed in claim 15, further comprising a second stop that limits displacement of the rotor relative to the shaft in an axial direction of the shaft so that the rotor is prevented from moving away from the output drum in the axial direction of the shaft.

* * * * *